United States Patent [19]

Seliger et al.

[11] 4,083,259

[45] Apr. 11, 1978

[54] APPARATUS FOR CRANKING THE ROTOR OF A TURBO MACHINE

[75] Inventors: Dieter Seliger; Arun-Kumar Das-Gupta, both of Munich, Germany

[73] Assignee: MTU Munchen GmbH, Munich, Germany

[21] Appl. No.: 727,832

[22] Filed: Sep. 29, 1976

[30] Foreign Application Priority Data

Oct. 1, 1975 Germany ..... 2543813

[51] Int. Cl.[2] ..... F16H 15/18; G05G 1/10

[52] U.S. Cl. ..... 74/191; 74/545; 235/95 R; 415/118; 415/201

[58] Field of Search ..... 74/6, 8, 191, 545, 550; 123/185 F, 185 P; 415/118, 201; 116/115, DIG. 21; 235/95 R, 121

[56] References Cited

U.S. PATENT DOCUMENTS

| | | | |
|---|---|---|---|
| 1,226,751 | 5/1917 | Chryst | 74/8 X |
| 1,332,032 | 2/1920 | Dick | 74/8 X |
| 2,254,844 | 9/1941 | Guedon | 74/191 |
| 2,357,199 | 8/1944 | Holst | 235/95 R |
| 2,688,946 | 9/1954 | Jarsaillon | 415/118 X |
| 3,917,432 | 11/1975 | Feuerstein | 415/118 |
| 3,985,465 | 10/1976 | Sheldon et al. | 415/201 X |

FOREIGN PATENT DOCUMENTS

| | | | |
|---|---|---|---|
| 2,114,916 | 3/1972 | Germany | 415/118 |

*Primary Examiner*—Allan D. Herrmann
*Attorney, Agent, or Firm*—Alan H. Levine

[57] ABSTRACT

A cranking apparatus comprising a shaft within a sleeve for insertion into a machine casing containing a rotor. The shaft carries a friction wheel for tangentially engaging a circular surface on the rotor, so that when the shaft is rotated the rotor will be cranked. The shaft may be angularly adjusted with respect to the rotor axis, and the friction wheel resiliently urged against the rotor surface. The sleeve may carry a revolution counter engaging the shaft.

10 Claims, 4 Drawing Figures

APPARATUS FOR CRANKING THE ROTOR OF A TURBO MACHINE

This invention relates to a cranking apparatus for a bladed rotor of a turbo machine and, more particularly, this invention relates to an apparatus for cranking a rotor of a multiple-spool gas turbine engine. The cranking apparatus essentially consists of a drive shaft rotatably supported in a sleeve-like member by which it is supported in an opening in the turbo machine casing, the apparatus reaching a point near the blades of the rotor to be cranked and the sleeve-like fixing it in its operating position wherein it cranks the rotor.

An apparatus of this description is known from German Pat. No. 2,114,916 and serves to crank one or more rotors of a gas turbine engine externally, and optionally by hand, in order to detect cracked or fractured rotor blades by means of test instruments on the engine. For this purpose, the known cranking apparatus includes a cranking umbrella which is inserted, through an opening in the casing, into a flow duct where it unfolds, and which is rotatably supported for engagement with a row of blades by means of arms deployed into the gaps between adjacent rotor blades.

The deploying mechanism needed to unfold the cranking umbrella makes this known apparatus a complex structure liable to damage the rotor blades of the rotor to be cranked as a result of less than perfectly accurate or proper operation.

Where the deploying arms of this known apparatus are made of a plastic material, one or more of the arms may break when an attempt is made to crank the rotor, and this may cause fragments of the plastic material to remain in the turbo machine or in a flow duct.

A further disadvantage inherent in this known cranking apparatus is that the cranking umbrella requires a relatively large space in its operating position, especially in comparison to rotor, blade, or stator portions of the turbo machine in the vicinity of the cranking umbrella.

Broadly speaking, the present invention eliminates these disadvantages of the known apparatus and provides a cranking apparatus for a bladed rotor of a turbo machine which requires relatively little space, especially in its operating position, and which at the same time is relatively easy to operate.

It is a particular object of the present invention to provide a cranking apparatus of the type described wherein the drive shaft has a friction wheel at the end facing the rotor to be cranked, the friction wheel being arranged, when the apparatus is in its operating position, at a tangent to a suitable cranking surface on the rotor.

The cranking surface on the rotor may be formed, e.g., by the respective faces of the various blade root platforms, or it may be formed on a forward edge of the rotor disk, or by such a cranking surface on the rotor, or on an associated disk as may be designed into the turbo machine in anticipation of such cranking provisions.

The cranking apparatus of the present invention is designed for direct contact of its friction wheel with the cranking surface on the rotor, which eliminates the need for considering the number and shape of the blades of the rotor to be cranked.

The cranking apparatus of this invention affords an advantage in the case of turbo machines having a relatively large number of closely spaced turbo components, such as lift jet engines or gas turbine jet engines of multiple-flow multiple-spool construction, which can thus be monitored accurately for, e.g., cracks in the material of the compressor or turbine blades.

Further objects and advantages of the present invention will become apparent from the following description read together with the accompanying drawings, in which.

Figure 1:
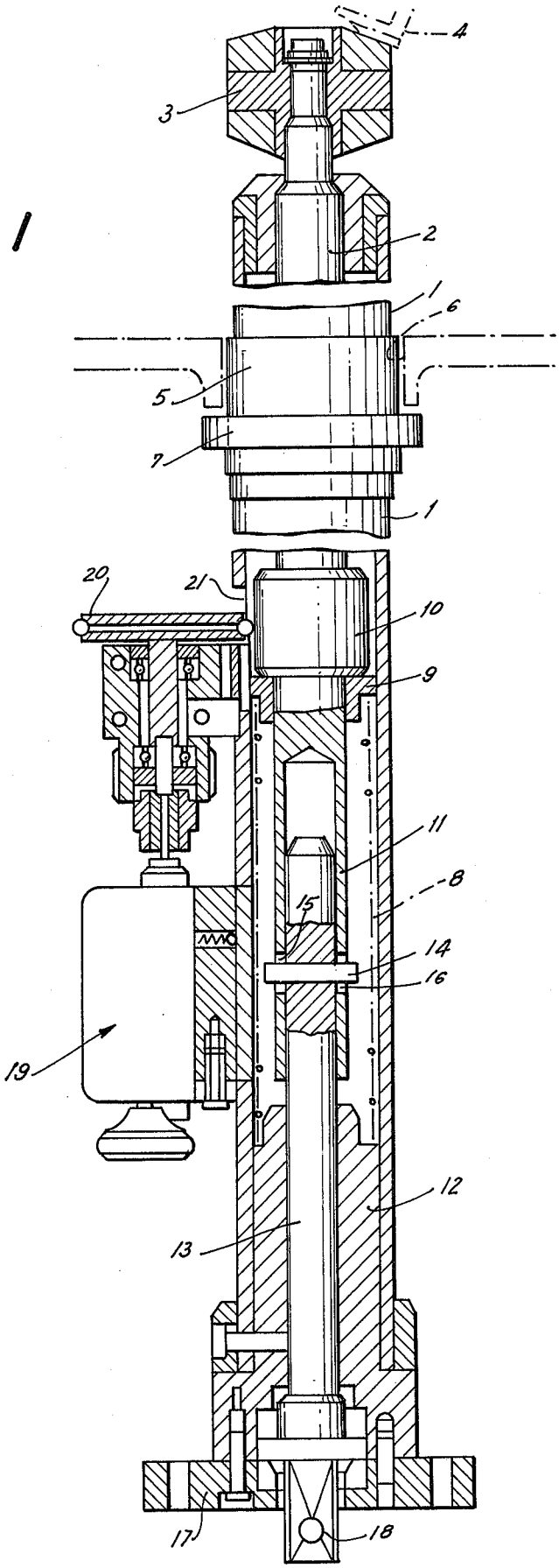
FIG. 1 is a longitudinal section illustrating an embodiment of the apparatus in accordance with this invention.
Figure 1A:
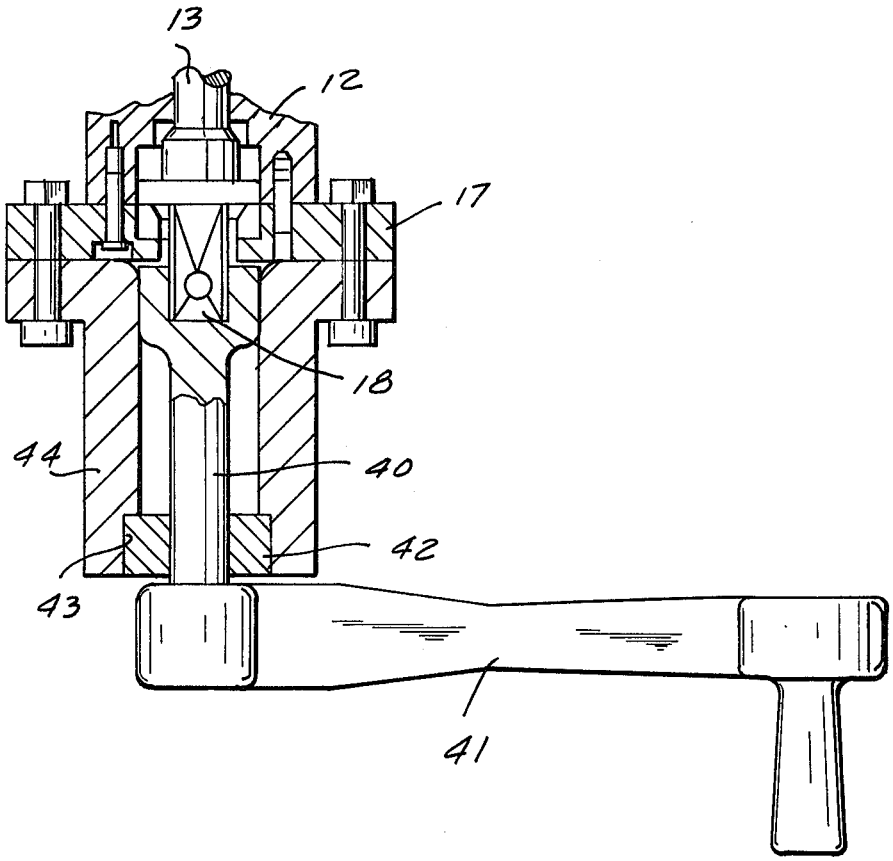
FIG. 1A is a fragmentary longitudinal section showing the end of the apparatus of FIG. 1 with a crank attached to it.

With reference now to FIG. 1 the cranking apparatus essentially consists of a drive shaft 2 rotatably supported in a sleeve 1 and fitted with a friction wheel 3 at its end facing the rotor to be cranked, for tangential contact with a suitable cranking surface 4 on the rotor. Sleeve 1 carries a collar 5 by which it is supported in an opening 6 in the machine casing, an annular flange 7 on collar 5 serving as a stop engaging the casing to limit the inserted length of apparatus into, e.g., a turbo machine in the form of a three-spool two-flow engine. This means that the cranking apparatus is ready to operate immediately after it has been inserted into an opening 6 of the casing.

For constant but not excessively hard contact of friction wheel 3 with the cranking surface 4 on the rotor, friction wheel 3 is supported, through drive shaft 2, for radial flexibility by a coil spring 8. Spring 8 is preloaded and, through spring seat 9 resting on a bushing 10 on drive shaft 2, urges friction wheel 3 against the cranking surface 4 of the rotor. For radial flexibility of the friction wheel 3, the drive shaft 2 is fitted with a forked tubular extension 11 gripping with some amount of play a shaft 13 rotatably supported in the handle 12 of the apparatus.

Shaft 13 has a dog 14 engaged on both sides within slots 15 and 16 of the forked tubular extension 11 of drive shaft 2. Slots 15 and 16 cooperate with dog 14 to limit the maximum extension of coil spring 8, which at its lower end rests against the end of the handle 12 projecting into sleeve 1.

The handle 12 of the apparatus is provided with a suitable flange 17, for attaching a crank or similar means, with a pin-type extension 18 of shaft 13 projecting from the flange. The extension 18 of shaft 13 may be in the form of square-head pin. A fitting 40 is provided having a square-shaped socket at one end, adapted to accommodate extension 18, and a crank 41 at its other end. Fitting 40 has a collar 42 rotatably supported within a recess 43 at the outer end of a hollow flanged casing 44. The flange of casing 44 is secured to the flange 17. Arranged laterally on sleeve 1 is a revolution counter 19 the friction wheel 20 of which is in contact tangentially with bushing 10 of drive shaft 2 through an opening 21 in sleeve 1. The counter is useful when inspecting the rotor of the turbo machine. For example, when the present apparatus is being used to turn the rotor and a stroboscope shows a break in a rotor blade, the counter 19 is set at "0". If it is known how many counting units shown on counter 19 equal one complete revolution of the rotor, the counter can tell when the rotor has completed a complete revolution, and when the broken blade appears again, it will be known that it is the blade previously seen and not a second broken blade. Furthermore, if the inspection process is interrupted at any time, it will be possible by means of the counter to return the rotor at a later time to the precise point at which the rotor was positioned at the time of interruption.

A preferred use of the cranking apparatus of FIG. 1 is for cranking the low pressure rotor of a three-spool gas turbine jet engine.

Figure 2:
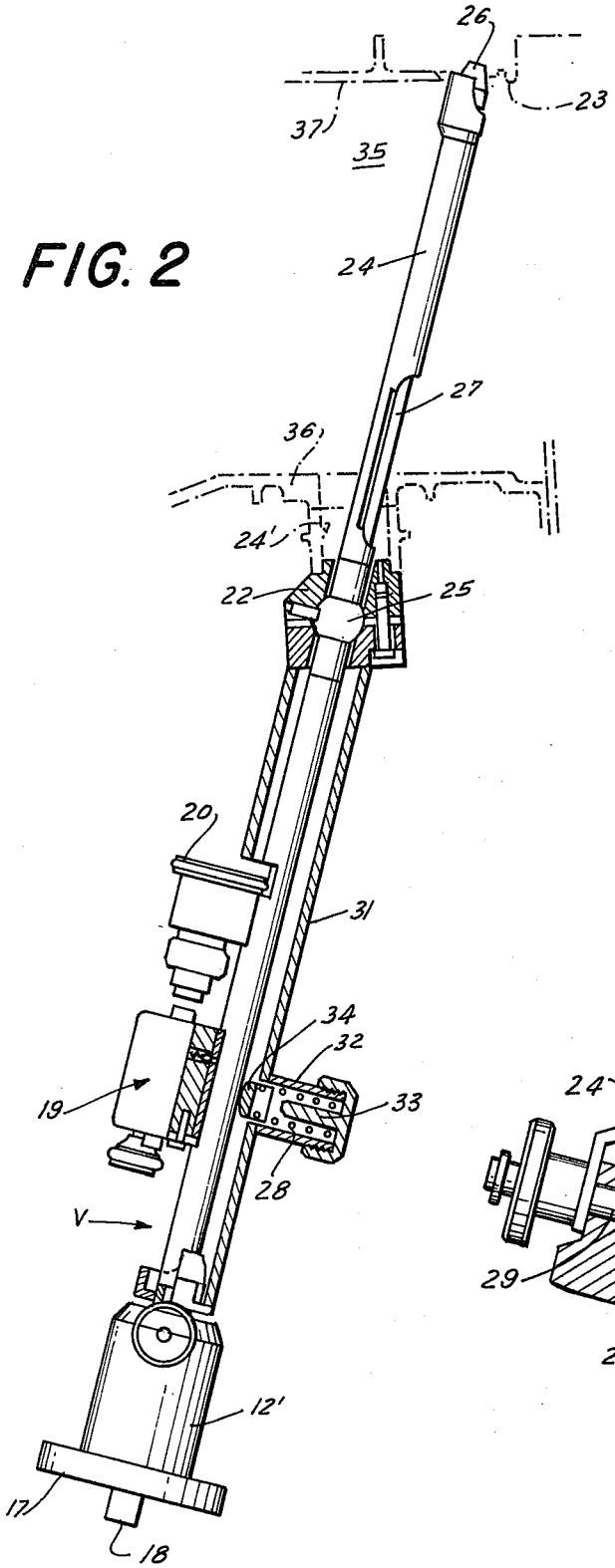
FIG. 2 is a longitudinal section illustrating an alternative embodiment of the cranking apparatus.

Using the same references for essentially unchanged components, FIG. 2 shows a cranking apparatus suited, e.g., for cranking the intermediate pressure compressor of a three-spool gas turbine jet engine. This cranking apparatus has an arresting means 22 for fixing it in an opening 24' in the compressor casing at an angle to the rotor axis or its cranking surface.

For this purpose, sleeve 24 is allowed a certain amount of swivel motion by means of a generally spherical section 25 within correspondingly shaped mating surfaces of arresting means 22. When the cranking apparatus is in the operating position it rests, through friction wheel 26 of drive shaft 27, against the cranking surface 23 of the rotor and also against a coil spring 28. The preload of the spring is adjustable to suit the intended contact pressure of the friction wheel 26 on the cranking surface 23 of the rotor.

Sleeve 24, including drive shaft 27, may be adjusted or fixed by means of adjusting screws 29 and 30 (FIG. 3, i.e., view V of FIG. 2) arranged on opposite sides of the handle 12' of the apparatus and at right angles to the direction of motion resulting from a variation in the preload on coil spring 28.

As is also apparent from FIG. 2, the apparatus is optionally enclosed, at least in part, between the arresting means 22 and the handle 12', by a tubular housing 31 having a lateral tubular extension 32. Within the tubular extension is a coil spring 28, the preload on which is adjusted by means of a nut 33 screwed over tubular extension 32. A thrust piece 34 is arranged between coil spring 28 and sleeve 24, its rounded end surface contacting the sleeve 24.

Figure 3:
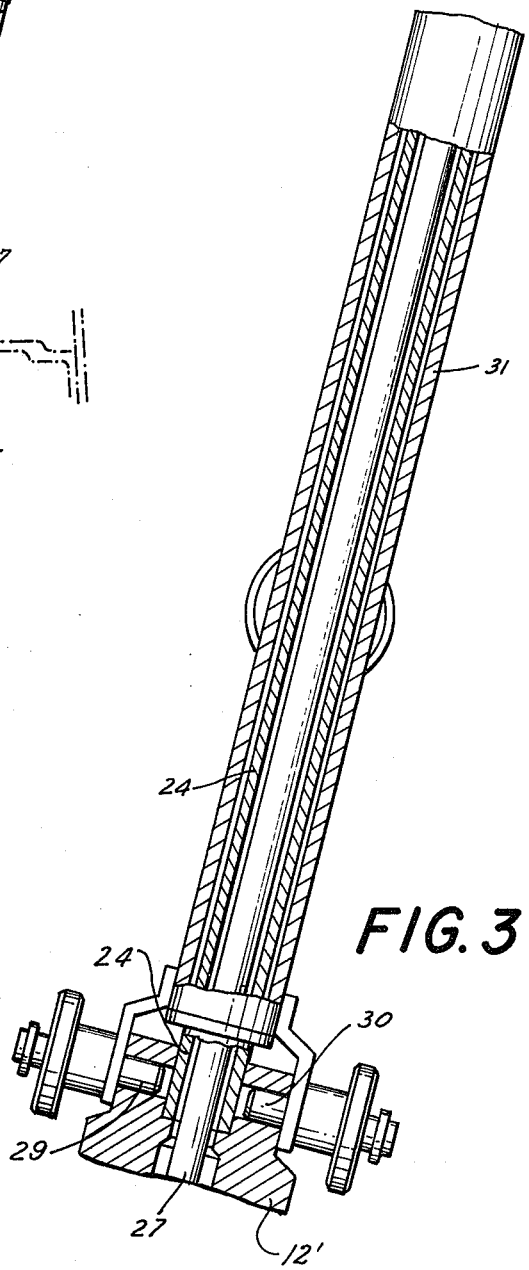
FIG. 3 is an enlarged detail view of the cranking apparatus booking in the direction V of FIG. 2.

The embodiment of FIGS. 2 and 3 likewise has a revolution counter 19 arranged laterally on sleeve 24 and driven from drive shaft 27 through friction wheel 20.

As will also be seen in FIG. 2, the cranking apparatus, as shown in the installed condition, extends through a bypass duct 35 between an outer casing section 36, having the opening 24' in it, and a casing section 37 associated with the inner wall of the bypass duct. Accordingly, the cranking apparatus of FIGS. 2 and 3 can be easily and accurately adjusted.

When, with the cranking apparatus of FIG. 2, the nut 33 is used to reduce the preload on coil spring 28, the friction wheel 26 can be removed from the cranking surface on the rotor sufficiently for the engine to be operated with the cranking apparatus still installed.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A cranking apparatus for the rotor of a turbo machine, the machine having a casing formed with an opening and the rotor within the casing having a circular surface, the apparatus comprising:

a. a shaft for insertion through the casing opening,
b. a sleeve surrounding said shaft, said shaft being rotatable within said sleeve,
c. means for limiting the amount which said sleeve can extend into the casing,
d. a friction wheel at one end of said shaft for tangentially engaging the circular surface of the rotor, and
e. means for rotating said shaft.

2. A cranking apparatus as defined in claim 1 including resilient means within said sleeve for urging said shaft longitudinally to urge said friction wheel against the circular surface of the rotor.

3. A cranking apparatus as defined in claim 1 including resilient means for urging said sleeve laterally to urge said friction wheel against the circular surface of the rotor.

4. A cranking apparatus as defined in claim 1 including means for maintaining said shaft at an acute angle to the axis of rotation of said rotor.

5. A cranking apparatus as defined in claim 4 wherein said maintaining means includes means for adjusting the angular position of said shaft with respect to the rotor axis.

6. A cranking apparatus as defined in claim 1 wherein said sleeve includes a generally spherical portion, and said limiting means includes corresponding shaped surfaces movably accommodating said spherical portion.

7. A cranking apparatus as defined in claim 1 including a pair of opposed adjusting screws movable laterally with respect to said sleeve for adjusting the angular position of said sleeve with respect to the rotor axis.

8. A cranking apparatus as defined in claim 1 including a handle at the end of said sleeve opposite said friction wheel, a tubular housing surrounding said sleeve between said limiting means and said handle, a tubular extension projecting laterally from said housing, a spring within said extension urging said sleeve laterally, and means carried by said extension for adjusting the force which said spring applies to said sleeve.

9. A cranking apparatus as defined in claim 8 wherein said adjusting means is a nut threadably engaging said extension, said spring being seated against said nut, and including a thrust piece between said spring and said sleeve, said thrust piece having a rounded surface engaging said sleeve.

10. A cranking apparatus as defined in claim 1 including a revolution counter mounted on said sleeve, said counter having a part engaging said shaft.

* * * * *